US011596241B2

(12) United States Patent
Vigers

(10) Patent No.: US 11,596,241 B2
(45) Date of Patent: Mar. 7, 2023

(54) SYSTEM AND METHOD FOR CONSOLIDATING CHILD CARE ACTIVITIES THROUGH A CHILDCARE STATION

(71) Applicant: Vacques A. Vigers, Sugarland, TX (US)

(72) Inventor: Vacques A. Vigers, Sugarland, TX (US)

( * ) Notice: Subject to any disclaimer, the term of this patent is extended or adjusted under 35 U.S.C. 154(b) by 0 days.

(21) Appl. No.: 16/542,177

(22) Filed: Aug. 15, 2019

(65) Prior Publication Data

US 2021/0045544 A1 Feb. 18, 2021

(51) Int. Cl.

| | |
|---|---|
| ***A47D 11/00*** | (2006.01) |
| ***A47K 1/05*** | (2006.01) |
| ***A47K 3/034*** | (2006.01) |
| ***A47D 1/00*** | (2006.01) |
| ***A47D 15/00*** | (2006.01) |
| ***A47D 5/00*** | (2006.01) |
| ***A47K 3/12*** | (2006.01) |
| *A47K 1/08* | (2006.01) |

(52) U.S. Cl.

CPC ..... *A47D 11/00* (2013.01); *A47D 1/008* (2013.01); *A47D 5/006* (2013.01); *A47D 15/008* (2013.01); *A47K 1/05* (2013.01); *A47K 3/034* (2013.01); *A47K 3/127* (2013.01); *A47K 1/08* (2013.01)

(58) Field of Classification Search

CPC ..... A47D 11/00; A47D 1/008; A47D 3/00; A47D 5/006; A47D 15/008; A47D 5/00; A47D 1/002; A47B 83/02; A47B 2220/03; A47K 1/05; A47K 3/034; A47K 3/127; A47K 1/08; A47K 3/164; A47K 3/064; A47K 3/024; A47K 3/00; A47K 3/001; A47K 3/005; A47K 1/02; A47K 3/074; A47K 3/12; B62B 7/12

See application file for complete search history.

(56) References Cited

U.S. PATENT DOCUMENTS 1,163,628 A * 12/1915 Gibson ..... A47D 1/0085 297/153
1,409,330 A * 3/1922 Aper ..... A47K 1/02 312/334.44
2,467,467 A * 4/1949 De Puy ..... A47D 5/006 108/27

(Continued)

OTHER PUBLICATIONS

"Shelf." Vocabulary, Vocabulary.com, https://www.vocabulary.com/dictionary/shelf.*

*Primary Examiner* — David R Hare
*Assistant Examiner* — Madison Emanski
(74) *Attorney, Agent, or Firm* — Spradley PLLC; Michael Spradley

(57) ABSTRACT

A childcare station is disclosed. The childcare station can comprise at least two or more pairs of collapsible legs and a body mounted on top of said legs. The body can comprise a depressed portion at the top surface of said body, a basin, a top cover, a plurality of storages at one side of the body, and a seat placed on the other side of the body. A bottom surface of the basin is compatible with the depressed portion. The top cover can attach at a top edge portion of the body such that the top cover serves as a barrier device in providing access to the basin. A method of use is also disclosed that comprises the step of mounting into a childcare station as described above.

7 Claims, 13 Drawing Sheets

(56) References Cited

U.S. PATENT DOCUMENTS

| | | | | | |
|---|---|---|---|---|---|
| 3,094,711 | A * | 6/1963 | Kentes | A47K 3/064 | 4/550 |
| 5,375,869 | A * | 12/1994 | Hsiao | A47D 1/06 | 280/648 |
| 9,713,403 | B2 * | 7/2017 | Taft | A47K 3/024 | |
| 2004/0139543 | A1 * | 7/2004 | Courouzos | A47D 5/00 | 4/572.1 |

* cited by examiner

SYSTEM AND METHOD FOR CONSOLIDATING CHILD CARE ACTIVITIES THROUGH A CHILDCARE STATION

BACKGROUND

This disclosure relates to a system and method for consolidating child care activities through a childcare station.

Providing the daily needs of a child involves a routine of feeding, washing, and diaper change. This can also be synonymous to using different methods and products to cater to each activity, such as using bathtub for bathing, changing tables for diaper change, and high chair for feeding. Traditionally, using a regular bathtub is observed when cleaning and bathing a child. However, bathtubs are commonly attached to the ground and are usually placed below knee level. Thus, cleaning a child in such method would require a user to kneel causing strain and pressure on the lower back. These methods and product can be effective however using several products can be more expensive, and unnecessary. Moreover, these methods and products can be confined in one place. Therefore, the user would need to move to several areas in the house in order to perform specific childcare activities. This can be very tiring, time consuming and inconvenient to a user. As such it would be useful to have an improved system and method for system and method for consolidating child care activities through a childcare station.

SUMMARY

A childcare station is disclosed. The childcare station can comprise at least two or more pairs of collapsible legs and a body mounted on top of said legs. The body can comprise a depressed portion at the top surface of said body, a basin, a top cover, a plurality of storages at one side of the body, and a seat placed on the other side of the body. A bottom surface of the basin is compatible with the depressed portion. The top cover can attach at a top edge portion of the body such that the top cover serves as a barrier device in providing access to the basin.

A method of use is also disclosed that comprises the step of mounting into a childcare station as described above.

DETAILED DESCRIPTION

Described herein is a system and method for consolidating child care activities through a childcare station. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
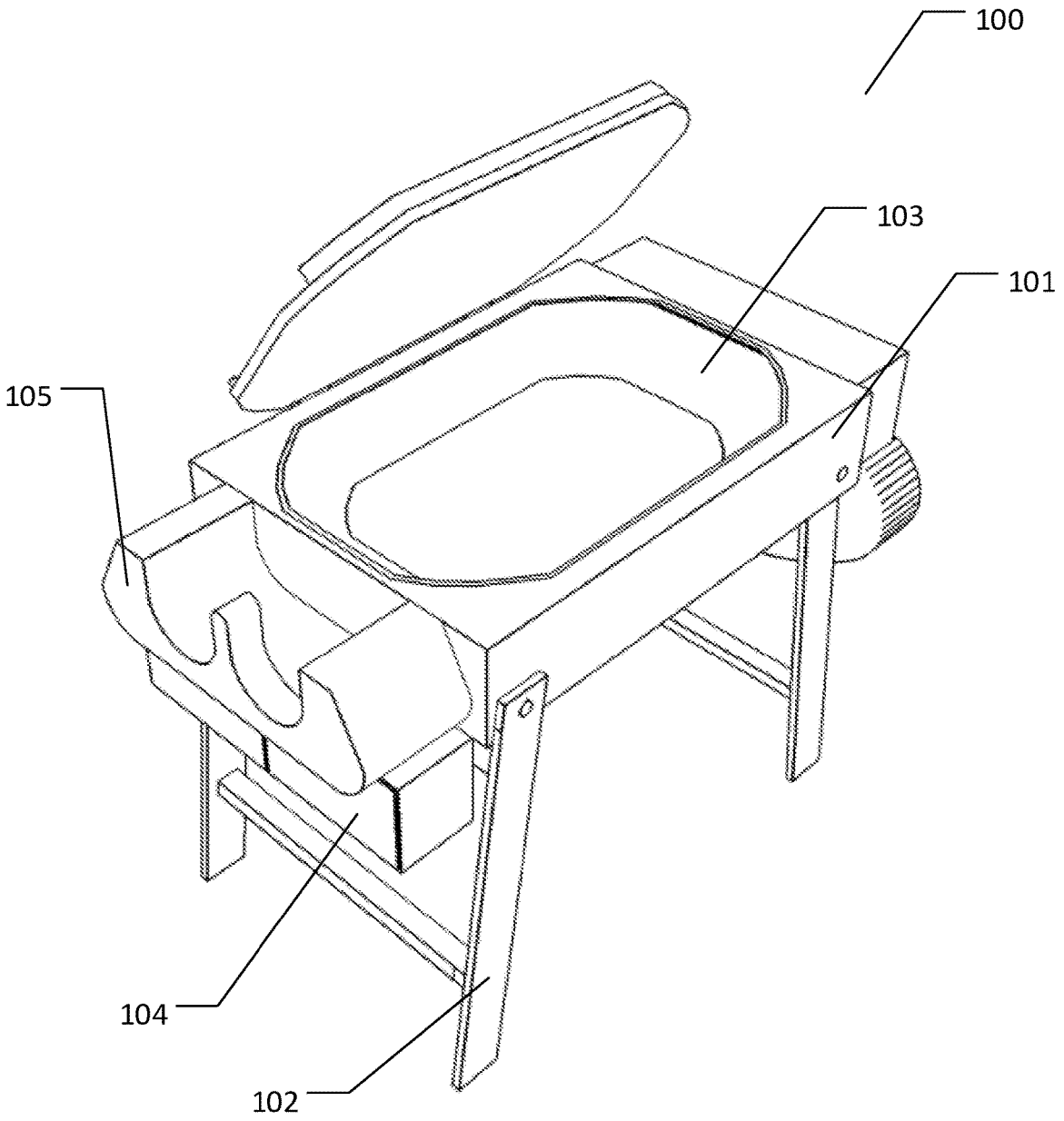
FIG. 1 illustrates a childcare station comprising a body, and a plurality of legs.

FIG. 1 illustrates a childcare station 100 comprising a body 101 and a plurality of legs 102. Childcare station 100 can be a raised platform that is designed to provide the everyday needs of a baby such as washing, cleaning, diaper change, and feeding. Childcare station 100 can be made of durable and lightweight materials such as plastic and/or wood. Body 101 can have a rectangular form that is mounted on top of legs 102. Body 101 can comprise a basin 103, a plurality of storages 104, and a seat 105. In a preferred embodiment, basin 103 can mount at the top surface of body 101 while storages 104 and seat 105 can attach at the sides of body 101. In one embodiment basin 103 can be removable from the top surface of body 101. This can allow the user to easily separate basin 103 from childcare station 100. Furthermore, this feature can allow user to easily clean basin 103. In one embodiment, legs 102 can be collapsible, which can make childcare station 100 be portable.

Figure 2:
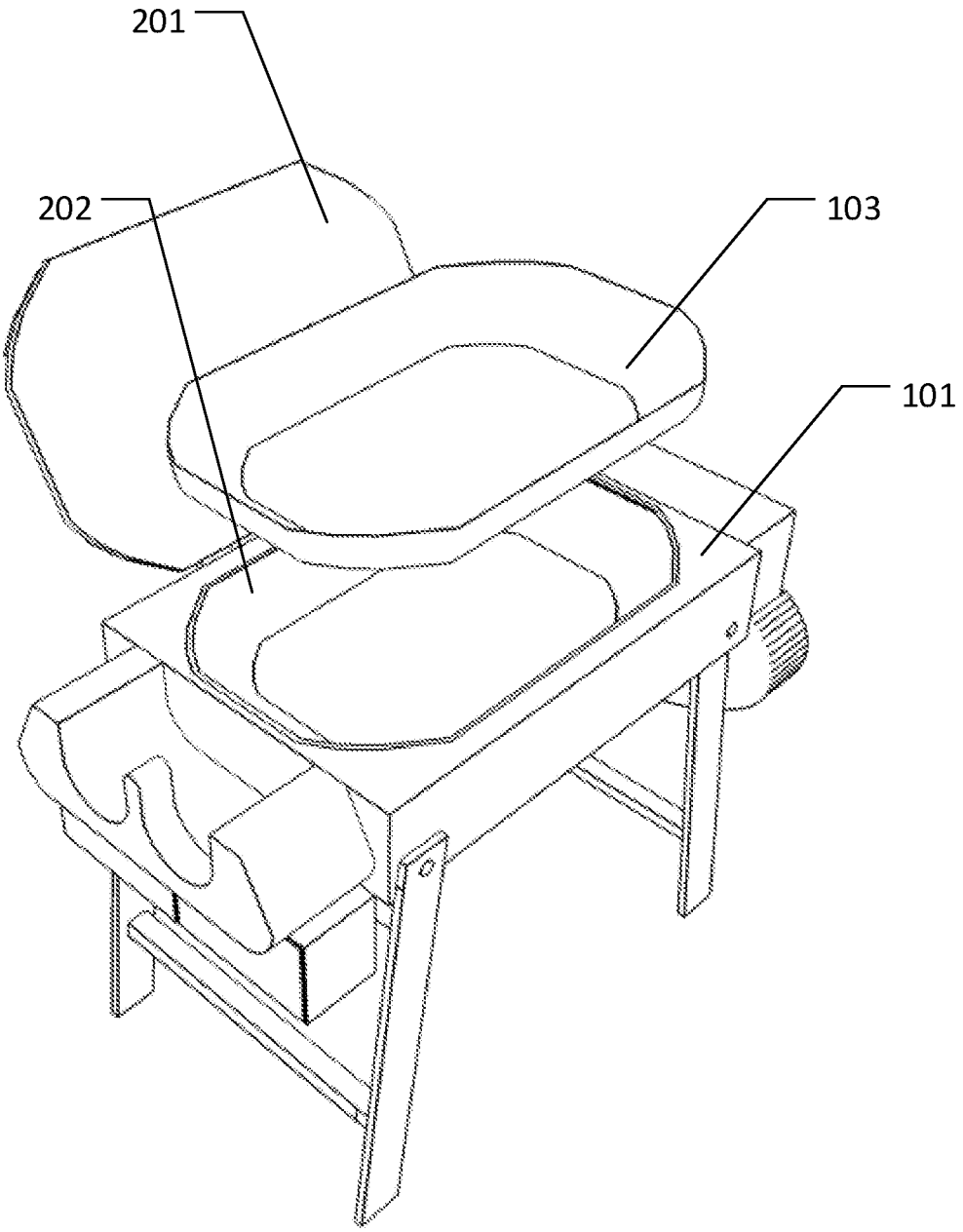
FIG. 2 illustrates an embodiment of a basin removed from a body.

FIG. 2 illustrates an embodiment of basin 103 removed from body 101. In this embodiment, the top surface of body 101 can comprise a depressed portion 202 that is compatible with the bottom surface of basin 103. This can allow basin 103 to fit snugly within body 101. Furthermore, top surface of body 101 can comprise a top cover 201. Top cover 201 can be a movable panel that serves as a barrier device in providing access to basin 103. In one embodiment, top cover 201 can have the same shape with basin 103. In another embodiment, top cover can be rectangular in shape. Furthermore, top cover 201 can attach at the top edge portion of body 101, in one embodiment. Top cover 201 can employ any type of lock system. For purpose of this disclosure, lock system mentioned herein can use various mechanisms that can allow top cover 201 to close and/or open body 101. In one embodiment, top cover 201 can use a hinged door mechanism. In such embodiment, a fastener device such as a hinge can enable top cover 201 to swing closed and/or open. In another embodiment, top cover 201 can utilize a sliding door mechanism. A track and guide system is utilized for top cover 201 to slide open. In one embodiment, top cover 201 is not connected to body 101 by any hinging mechanisms. Instead, top cover 201 can connect directly to basin 103.

Figure 3:
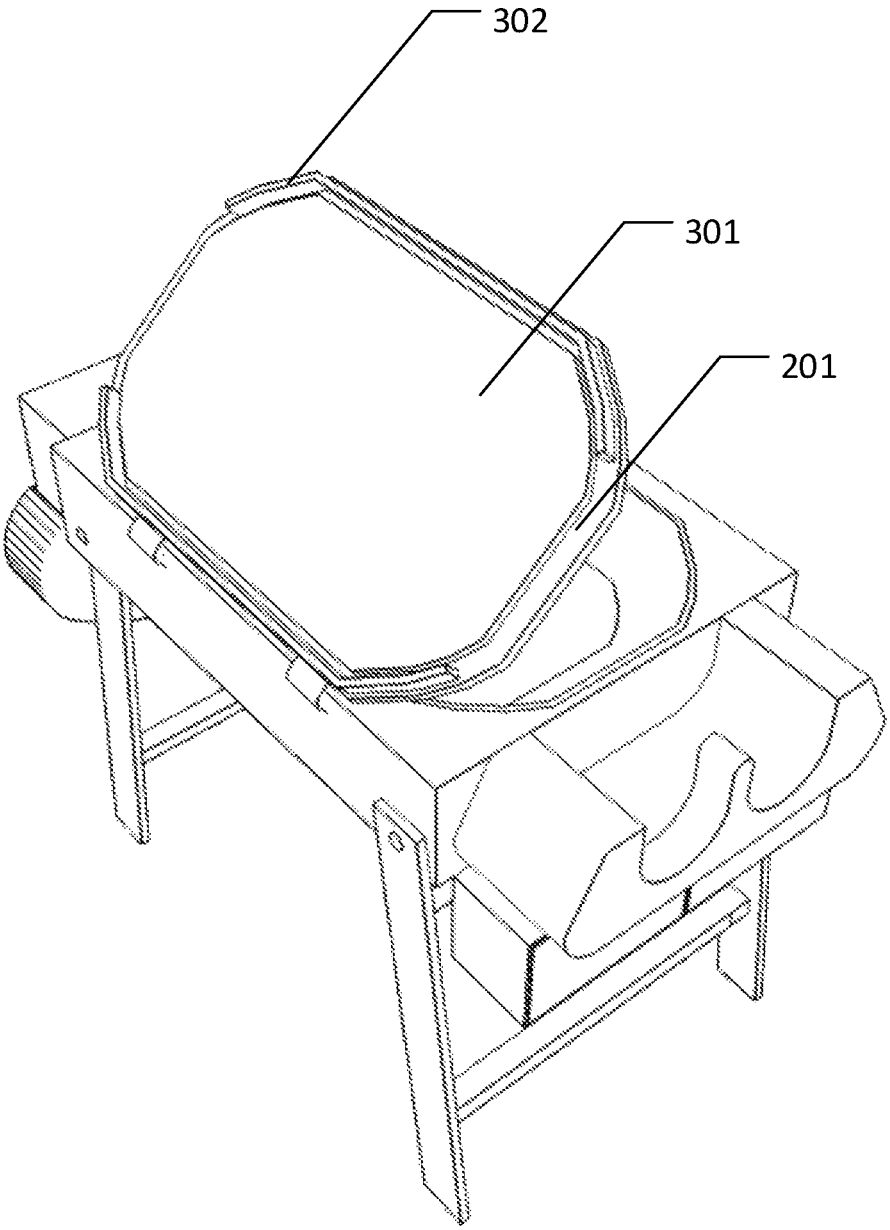
FIG. 3 illustrates an embodiment of a top cover comprising a cushion, and at least two or more guardrails.

FIG. 3 illustrates an embodiment of top cover 201 comprising a cushion 301, and at least two or more guard rails 302. Cushion 301 can mount the top surface of top cover 201. Moreover, cushion 301 can be removable from top cover 201, which can allow user to easily clean cushion 301. Cushion 301 can be waterproof, in one embodiment. Cushion 301 can provide comfortable and clean area for changing the diaper and dressing up a baby. Guard rails 302 can be placed at the side edges of top cover 201. This can prevent the baby from rolling out of top cover 201.

Figure 4:
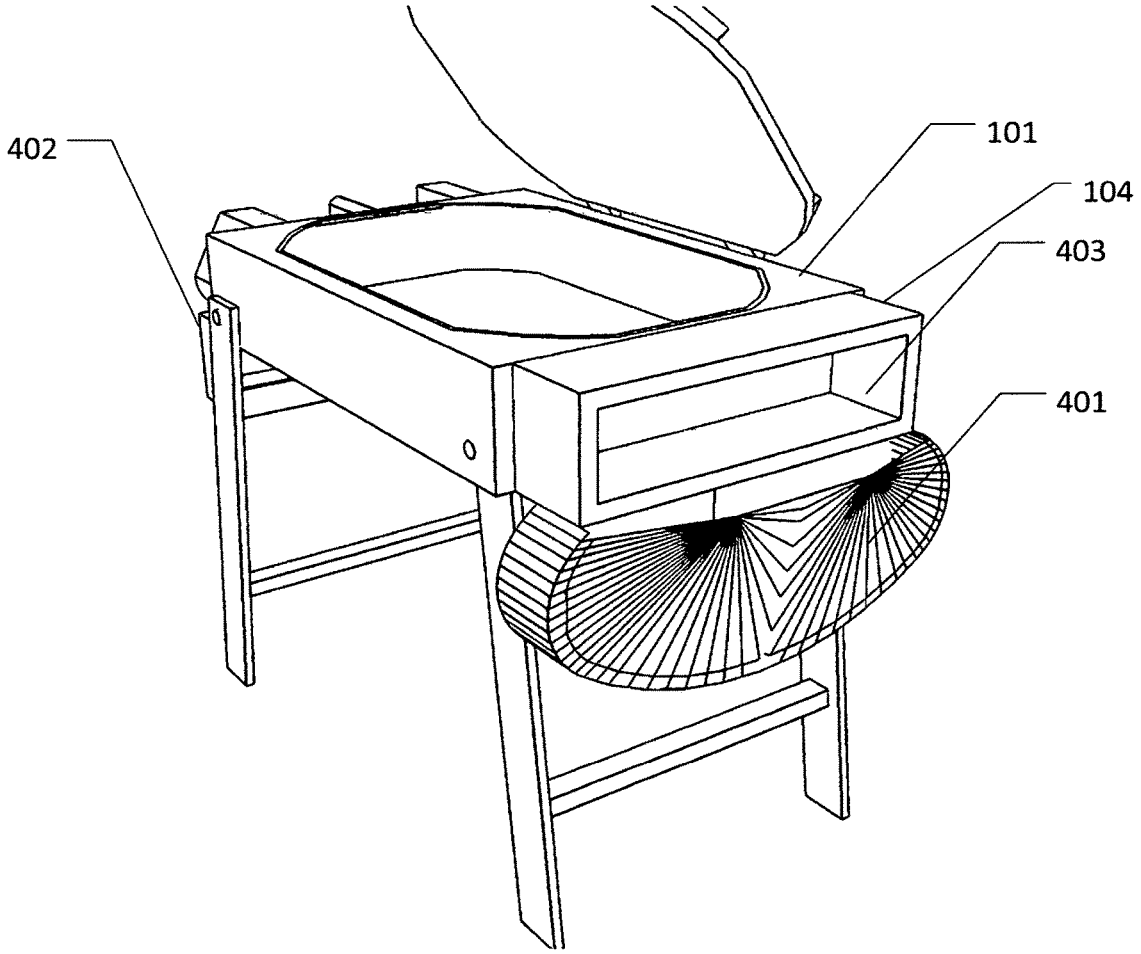
FIG. 4 illustrates one side of a body comprising one or more first storages, and a storage net.

FIG. 4 illustrates one side of body 101 comprising storages 104, and a storage net 401. Storages 104 can attach at the topside portion of body 101 and can align beneath basin 103. For purposes of this disclosure, storages 104 can be used to contain various baby essentials that can include but is not limited to diapers, clothes, socks, baby wipes, powder, cologne, and lotion. In one embodiment, storages 104 can be one or more drawers 402. Drawers 402 can be used to store items, such as clean clothes, towels, and diapers, which needs to be enclosed to prevent exposure to dirt, and other contamination. In another embodiment, storages 104 can be one or more shelves 403. Shelves 403 can allow baby items to be easily seen, and accessed. Storage net 401 can attach below storages 104 through method that can include but is not limited to fastening. Storage net 401 can store soiled clothes, or used diapers. In one embodiment, storage net 401 can be removable from childcare station 100. This can allow user to easily remove, and transfer or dispose soiled clothes and diapers.

Figure 5:
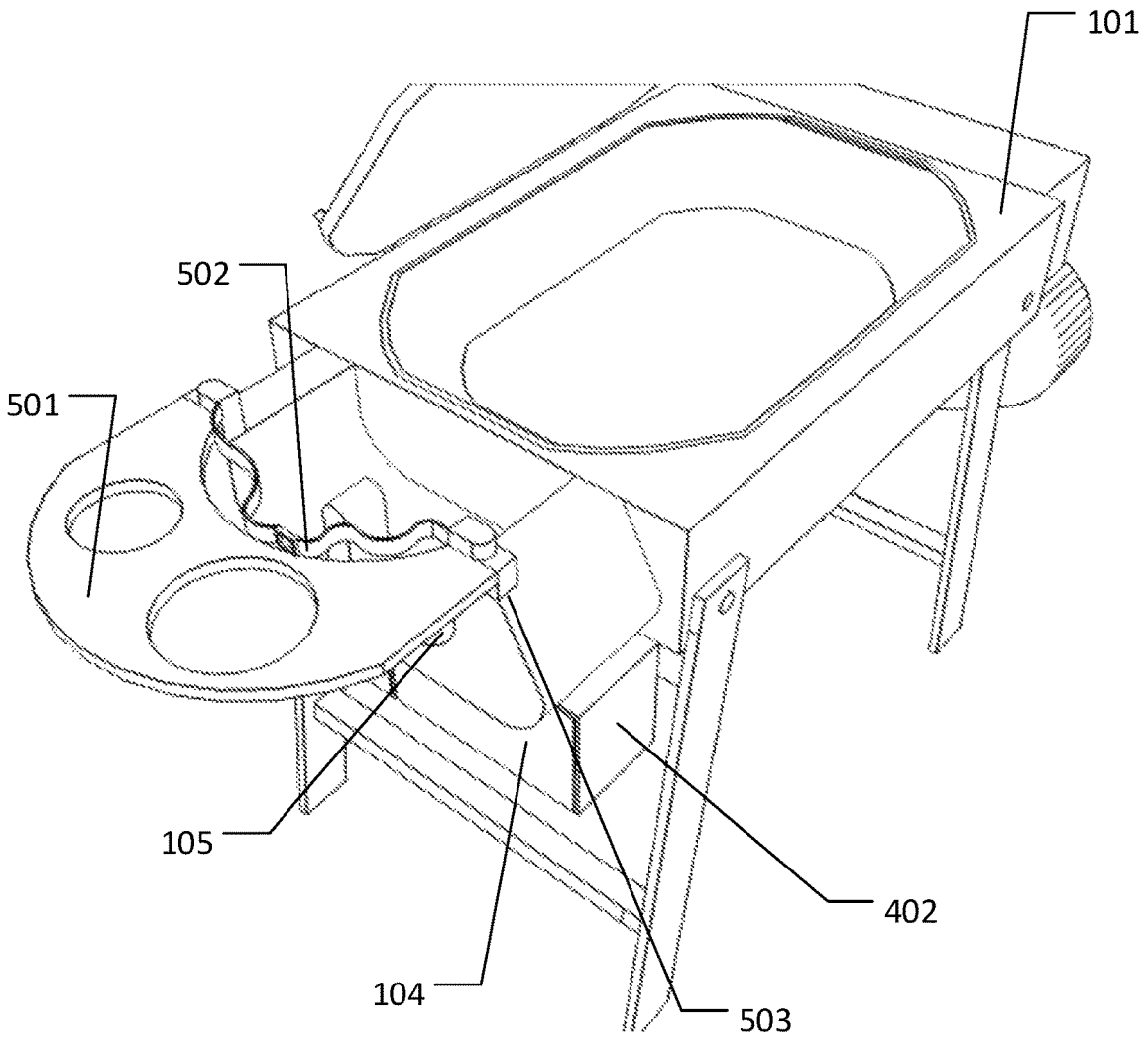
FIG. 5 illustrates the other side of a body comprising a seat, and one or more second storages.

FIG. 5 illustrates the other side of body 101 comprising seat 105, and another storages 104. Seat 105 can mount at the other topside portion of body 101. Seat 105 can comprise a tray 501 and a strap 502. Tray 501 can be placed at the top portion of seat 105. Tray 501 can permanently attach to seat 105, in one embodiment. In another embodiment, tray 501 can be detachable and re-attachable to seat 105. In some embodiments, tray 501 can temporarily detach from one side of seat 105 such that tray 501 is configured to fold upward and downward to open and close seat 105. This structure can allow user to easily place a child within seat 105. Once the child is in place, tray 501 can be pulled down to secure tray 501 within arm 503. In this embodiment, tray 501 can comprise a lock to ensure that tray 501 maintains its closed position. Strap 502 can connect at the side portions of seat 105. Strap 502 can secure a child within seat 105 and prevent the child from slipping out of seat 105. Storages 104 can attach directly below seat 105. In a preferred embodiment, storages 104 placed under seat 105 can be drawers 402.

Figure 6:
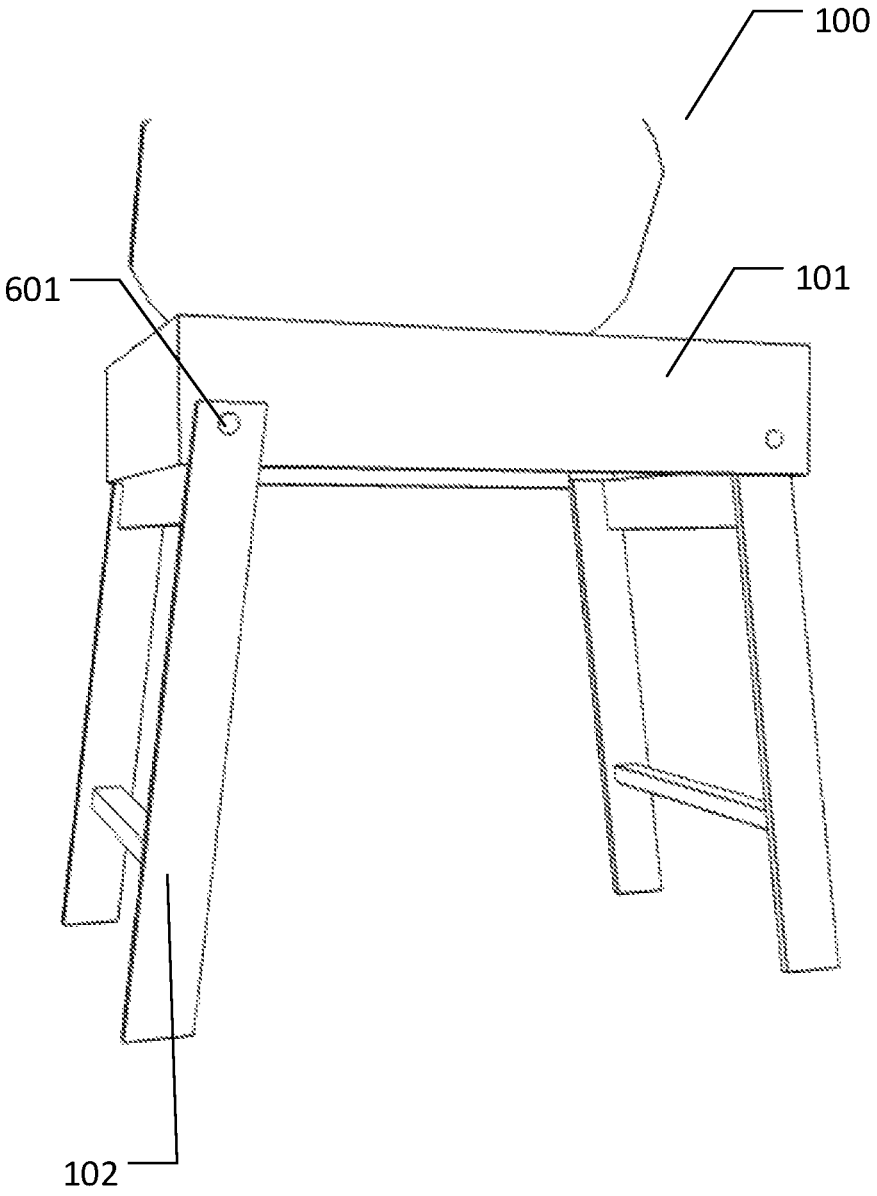
FIG. 6 illustrates an embodiment of legs in an expanded position.

FIG. 6 illustrates an embodiment of legs 102 in an expanded position. In this embodiment, two pairs of legs 102 can attach at the corners of body 101 through a fastener 601. For purposes of this disclosure fastener 601 can be any form of fastening device that can allow legs 102 to fold, which can include but is not limited to folding table leg brackets, hinges, nuts, and bolts. Each leg 102 can form a slanting position in order to form a wider base at the bottom. The wide base structure can add stability to childcare station 100. In one embodiment, each pair of legs 102 can connect together through a brace support 601. Brace support 601 can provide additional security and stability to legs 102.

Figure 7:
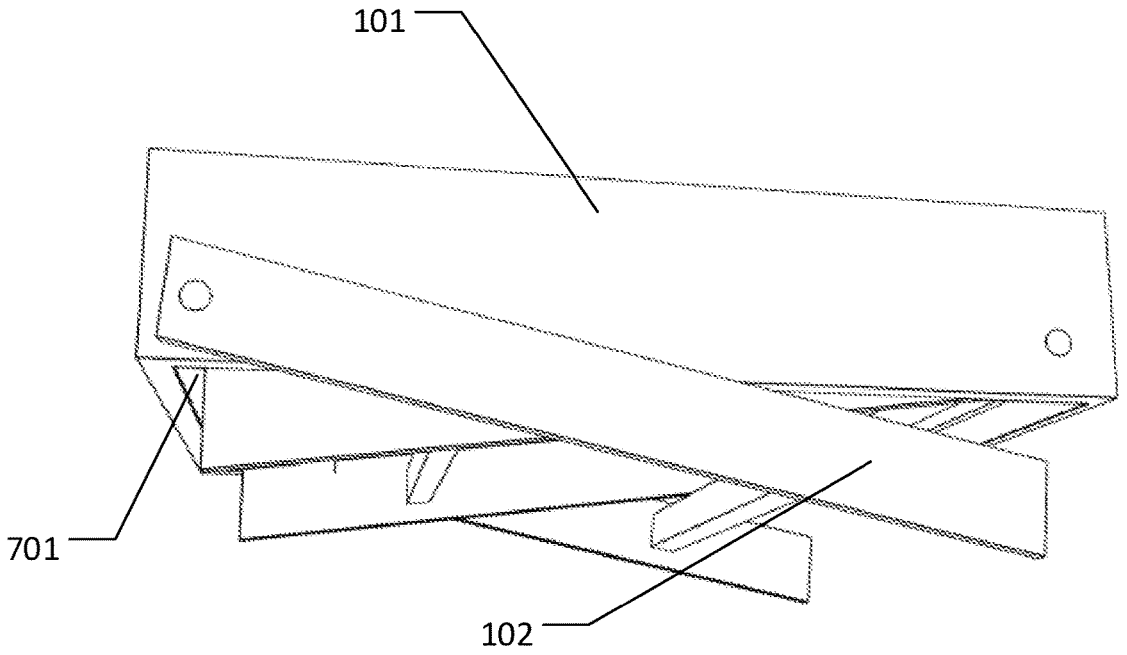
FIG. 7 illustrates an embodiment of legs in a collapsed position.

FIG. 7 illustrates an embodiment of legs 102 in a collapsed position. In this embodiment, the pair of legs 102 can be folded into the middle portion of body 101. In such embodiment, body 101 can comprise a cavity 701. Cavity 701 can be a void at the bottom surface of body 101 that can fit at least a pair of legs 102. In another embodiment, pairs of legs 102 can be folded onto the sides of body 101. This feature can allow childcare station be portable, and stored easily.

Figure 8:
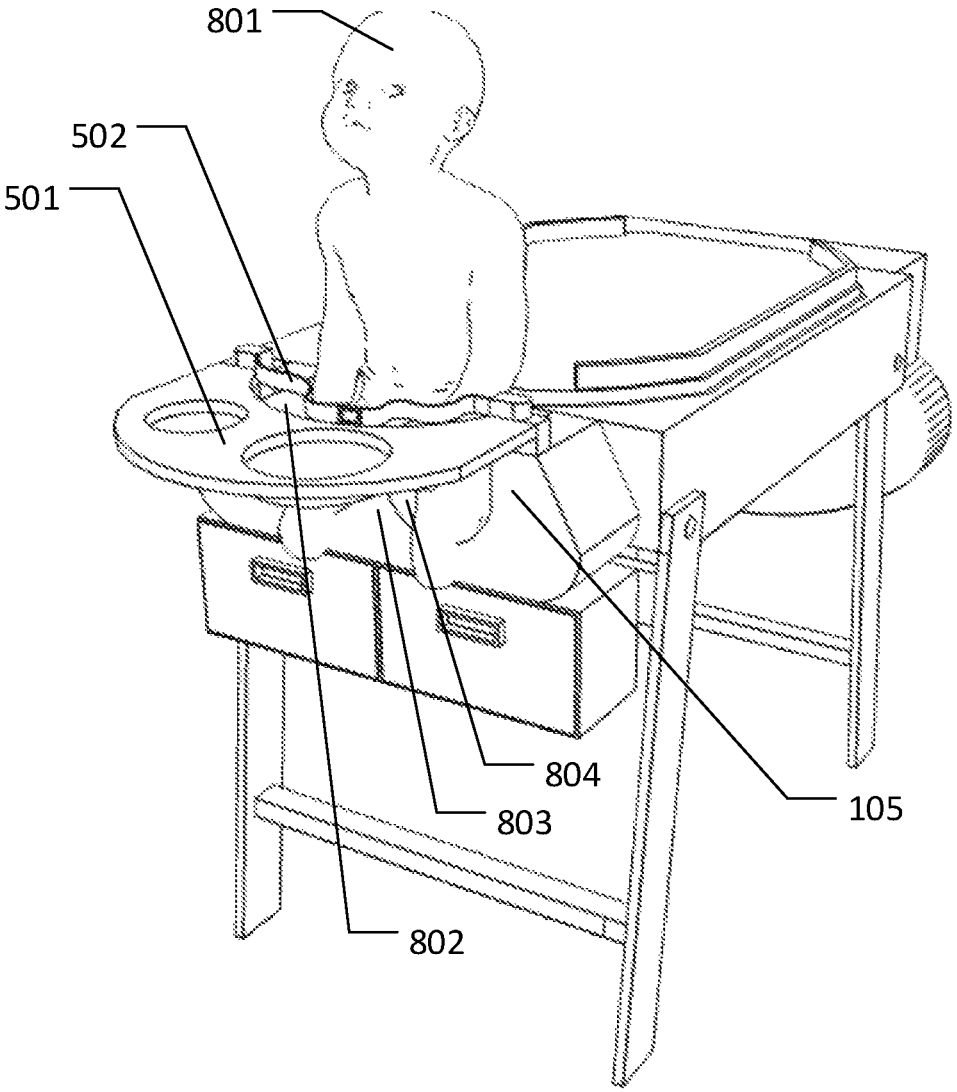
FIG. 8 illustrates a user feeding a child that is mounted within a seat.

FIG. 8 illustrates feeding a child 801 that is mounted within seat 105. In an embodiment wherein tray 501 can permanently attach to seat 105, child 801 can be placed within a hole 802 that is created between tray 501 and seat 105. In an embodiment wherein tray 501 can be removable from seat 105, the user can detach or open tray 501 before mounting child 801 into seat 105. Once child 801 is in place, the user can re-attach tray 501 to close tray 501 thus, securing child 801 within seat 105. Strap 502 can also be used to ensure child 801 does not slip off from seat 105. In these embodiments, seat 105 can comprise a contoured seat to support a child's posture. In other embodiments, seat 105 can comprise a leg guide 803, which places each of the child's legs in a leg cavity 804 for additional security.

Figure 9:
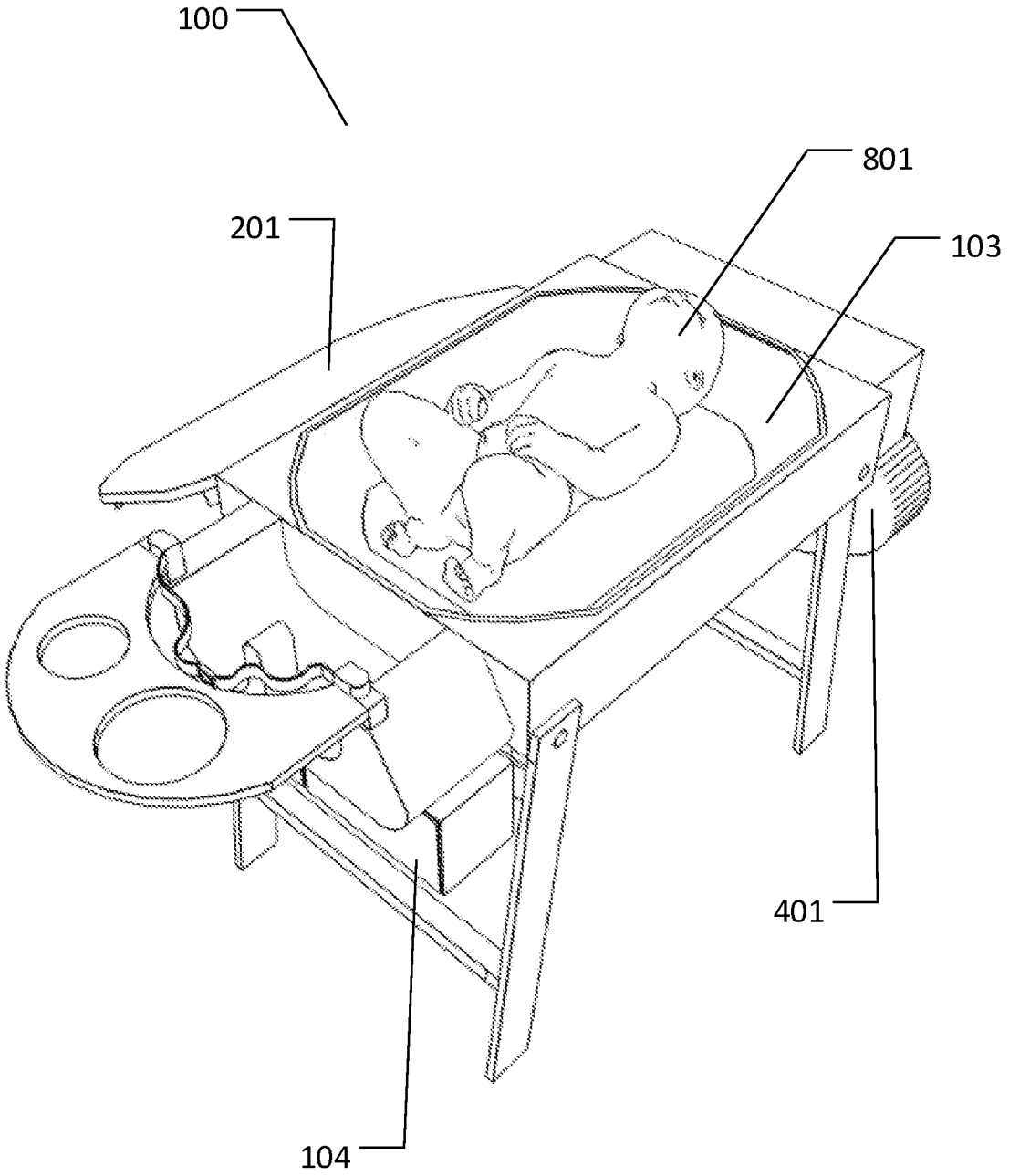
FIG. 9 illustrates a user cleaning a child within a basin.

FIG. 9 illustrates cleaning child 801 within basin 103. In a scenario wherein child 801 has soiled his clothes after eating or needs a diaper change, the user can use basin 103 for cleaning. The user can remove top cover 201 to access basin 103 and wash child 801 or use baby wipes for cleaning. Since childcare station 100 can comprise storages 104, the user can easily get the child's sanitary needs such as diaper cream, towels, clean clothes, and baby wipes from storages 104. Right after cleaning child 801, the user can place soiled clothes or used diaper into storage net 401. Furthermore, basin 103 can be removed from body 101 to discard contents of basin 103.

Figure 10:
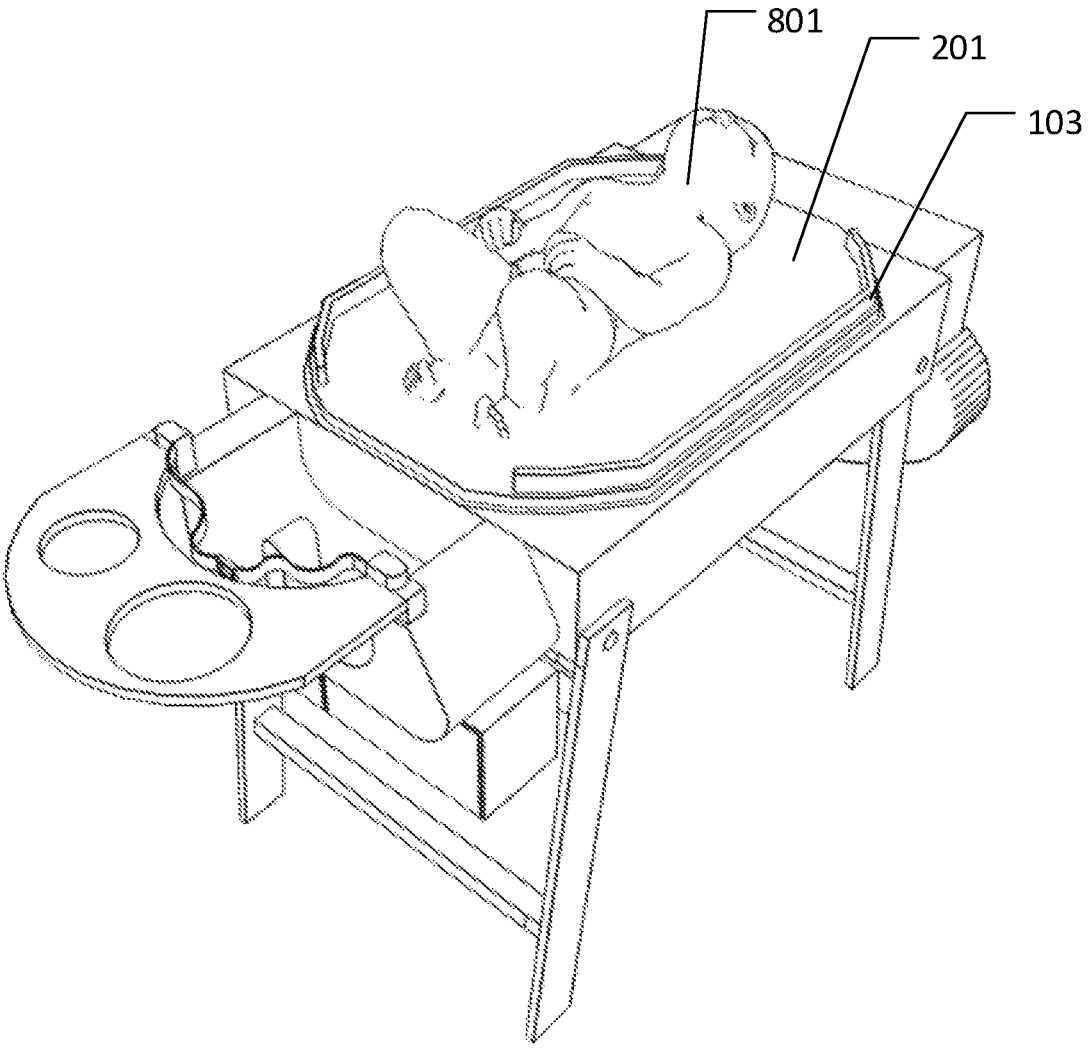
FIG. 10 illustrates a user changing the diaper of a child on a top cover.

FIG. 10 illustrates changing the diaper of child 801 on top cover 201. After washing child 801 on basin 103, the user can close basin 103 by putting top cover 201 back in place. Once in place, the user can mount child 801 at the surface of top cover 201 and use top cover 201 for diaper change.

Figure 11:
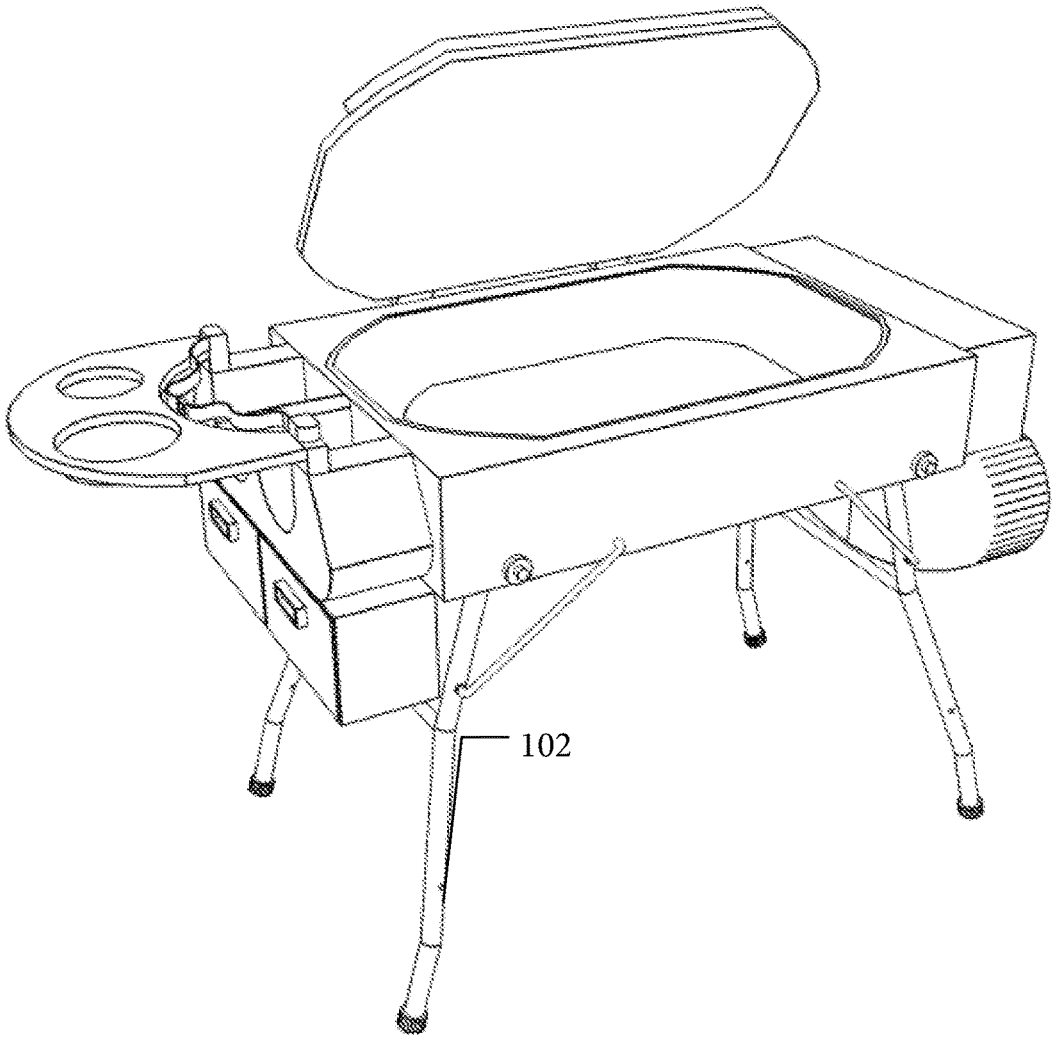
FIG. 11 illustrates another embodiment of a childcare station with foldable legs.

FIG. 11 illustrates another embodiment of a childcare station with foldable legs 102. In one embodiment, legs 102 can be metal or plastic.

Figure 12:
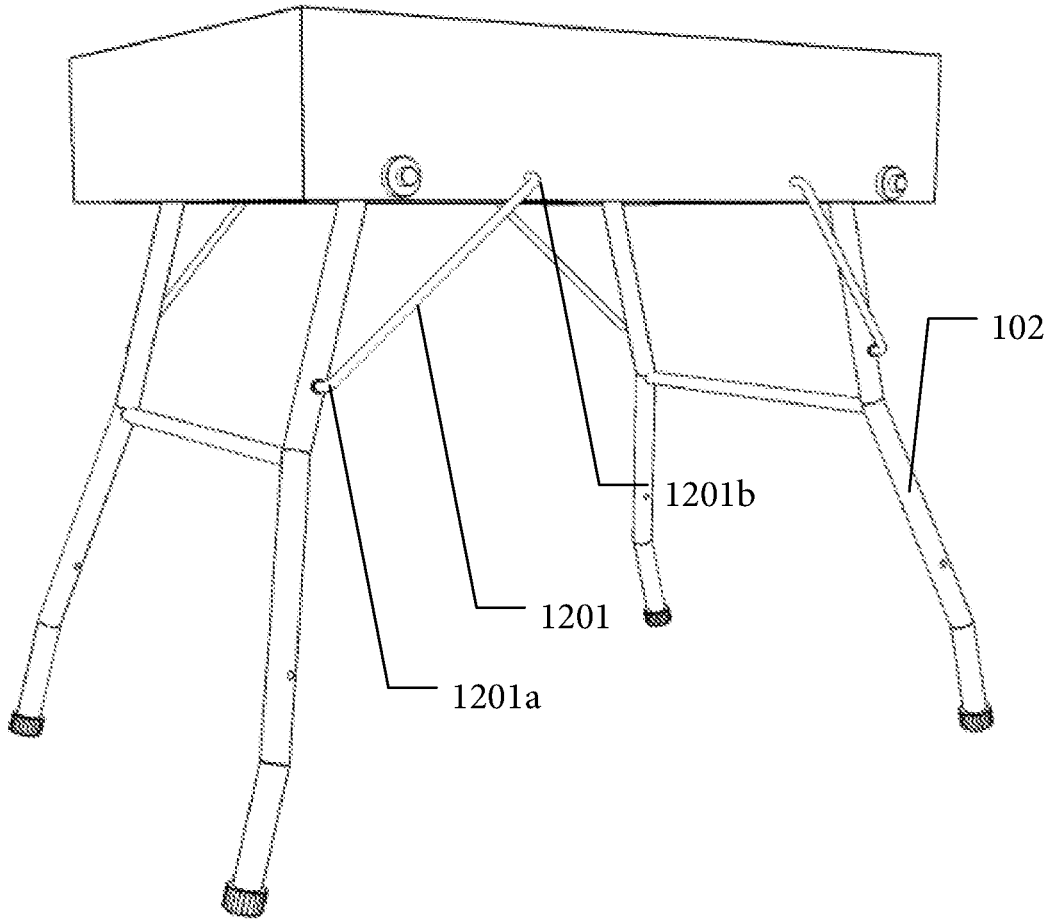
FIG. 12 illustrates another embodiment of a childcare station with foldable legs.

FIG. 12 illustrates another embodiment of a childcare station with foldable legs 102. In one embodiment, foldable legs can have supports 1201. Each supports 1201 can have a proximal end 1201*a* and a distal end 1201*b*. Proximal end 102*a* can connect to leg 102, while distal end 102*b* can connect to body 101.

Figure 13:
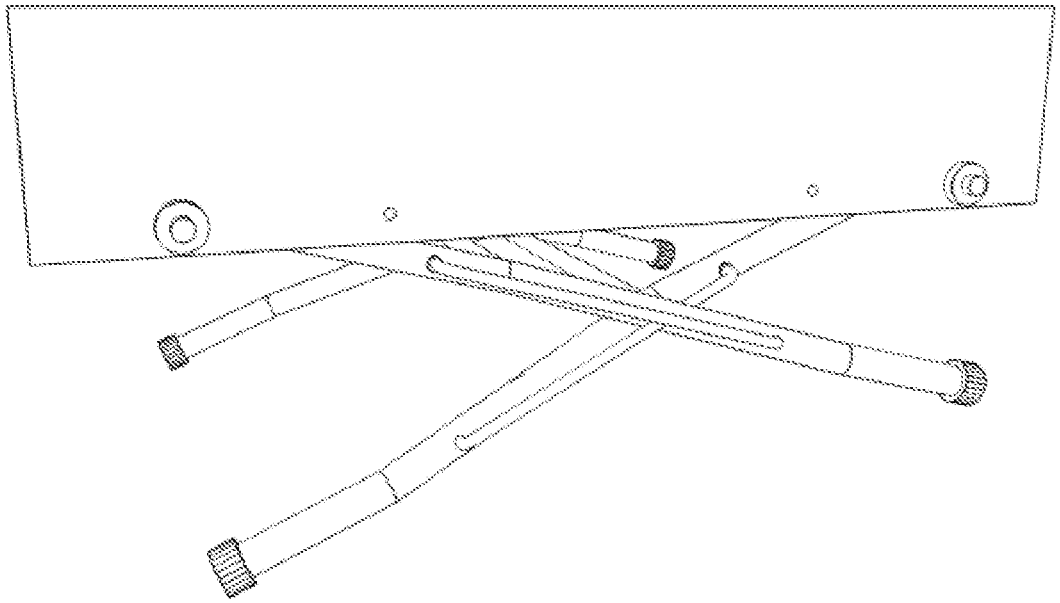
FIG. 13 illustrates another embodiment of a childcare station with foldable legs folded.

FIG. 13 illustrates another embodiment of a childcare station with foldable legs 102 folded. In once embodiment, distal ends 102*b* can disconnect from body 101 and connect to legs 102. Once distal ends 102*b* are disconnected, legs 102 can fold.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled.

In the appended claims, the terms "including" and "in which" are used as the plain-English equivalents of the respective terms "comprising" and "wherein."

What is claimed is:

1. A method for caring of a child through a childcare station comprising the steps of mounting a child into a childcare station, wherein said childcare station comprises at least two or more pairs of collapsible legs; and a body mounted on top of said legs, said body further comprising a depressed portion at the top surface of said body;

a basin, the bottom surface of said basin is compatible with said depressed portion;

a top cover that attaches at the top edge portion of said body such that said top cover serves as a barrier device in providing access to said basin;

a plurality of storages placed at one side of said body; and a seat placed on the other side of said body;

wherein said top cover comprises a removable cushion mountable at the top surface of said top cover; and at least two or more guard rails placed at the side edges of said top cover;

and comprising the step of feeding a child mounted on said seat.

2. The method of claim 1 wherein said seat further comprises a tray placed at the top portion of said seat; further wherein said tray detachable at one side of said seat, said tray configured to fold upward and downward to open and close said seat.

3. The method of claim 2 further comprising the steps of detaching said tray prior to mounting said child into said seat; and re-attaching said tray to said seat after mounting said child into said seat.

4. The method of claim 1 further comprising the step of cleaning said child mounted within said basin.

5. The method of claim 4 further comprising the step of removing said basin from said body to discard contents.

6. The method of claim 4 further comprising the steps of closing said top cover; and mounting said child at the top surface of said top cover for diaper change.

7. The method of claim 6 further comprising the step of placing used diaper or soiled clothes into a storage net.

* * * * *